US007334913B1

(12) United States Patent
Chen

(10) Patent No.: US 7,334,913 B1
(45) Date of Patent: Feb. 26, 2008

(54) DISPLAY ORNAMENT

(76) Inventor: Chin-Nan Chen, No. 186, Sec. 2, Min Chuan East Road, Taipei City (TW)

( * ) Notice: Subject to any disclaimer, the term of this patent is extended or adjusted under 35 U.S.C. 154(b) by 0 days.

(21) Appl. No.: 11/727,019

(22) Filed: Mar. 23, 2007

(51) Int. Cl.
*F21L 4/00* (2006.01)

(52) U.S. Cl. ..... 362/186; 362/806; 362/565; 446/236; 446/242

(58) Field of Classification Search ..... 362/183, 362/806–809, 101, 186, 565, 182, 173, 363; 446/285, 242, 236; 310/30, 15
See application file for complete search history.

(56) References Cited

U.S. PATENT DOCUMENTS 3,112,929 A * 12/1963 Gisser ..... 273/441
5,324,224 A * 6/1994 Anderson et al. ..... 446/91
6,078,000 A * 6/2000 Chen ..... 84/107
6,877,883 B2 * 4/2005 Lau Ting Yup et al. .... 362/363

* cited by examiner

*Primary Examiner*—Thomas M. Sember
*Assistant Examiner*—Julie A. Shallenberger
(74) *Attorney, Agent, or Firm*—Bacon & Thomas, PLLC

(57) ABSTRACT

A display ornament includes a transparent or translucent container for hanging on a Christmas tree or support, a light source, an ornament in the container, a driving mechanism, a circuit board with a solenoid for causing the driving mechanism to rotate the ornament, and a solar panel for collecting light energy from the light source and converting light energy into electrical energy for the working of the circuit board.

16 Claims, 5 Drawing Sheets

DISPLAY ORNAMENT

BACKGROUND OF THE INVENTION

1. Field of the Invention

The present invention relates to ornaments and more particularly, to a display ornament for hanging on a Christmas tree or support, which provides solar power or battery power to rotate an ornament.

2. Description of the Related Art

Christmas tree light sets or decorative light strings are commonly used to decorate trees, houses, etc. during Christmas or a particular memorial day. A Christmas light set or decorative light string has multiple bulbs connected in series and controlled to flash by an electronic circuit. Still and/or motion display ornaments may be used with Christmas light sets or decorative light strings for decoration. A motion display ornament uses a motor to move a doll, Santa Claus, dear, or any of a variety of ornaments. When power is switched on, the motor is started to rotate or move the ornament, and at the same time the Christmas light set or decorative light string is controlled to produce a lighting effect. Because the motor of the display ornament and the Christmas tree light set or decorative light string are electrically connected in series, the motor may fail easily.

Therefore, it is desirable to provide a display ornament that eliminates the aforesaid drawback.

SUMMARY OF THE INVENTION

The present invention has been accomplished under the circumstances in view. It is the main object of the present invention to provide a display ornament, which uses internal power source to rotate an ornament, eliminating external electrical wiring. It is another object of the present invention to provide a display ornament, which uses a solar panel to convert light energy into electrical energy for charging a battery to provide the necessary working voltage.

In one embodiment, the display ornament comprises a transparent or translucent container that can be hung on a Christmas tree or a wall, a light source for eliminating the inside space of the container, an ornament mounted inside the container, a driving mechanism, a circuit board with a solenoid for causing the driving mechanism to rotate the ornament, and a solar panel for collecting light energy from the light source and converting light energy into electrical energy for the working of the circuit board.

In another embodiment of the present invention, a battery pack is used and electrically connected to the circuit board and the solar panel. Electrical energy produced by the solar panel is stored in the battery pack, which provides the necessary working voltage to the circuit board.

DETAILED DESCRIPTION OF THE PREFERRED EMBODIMENT

Figure 1:
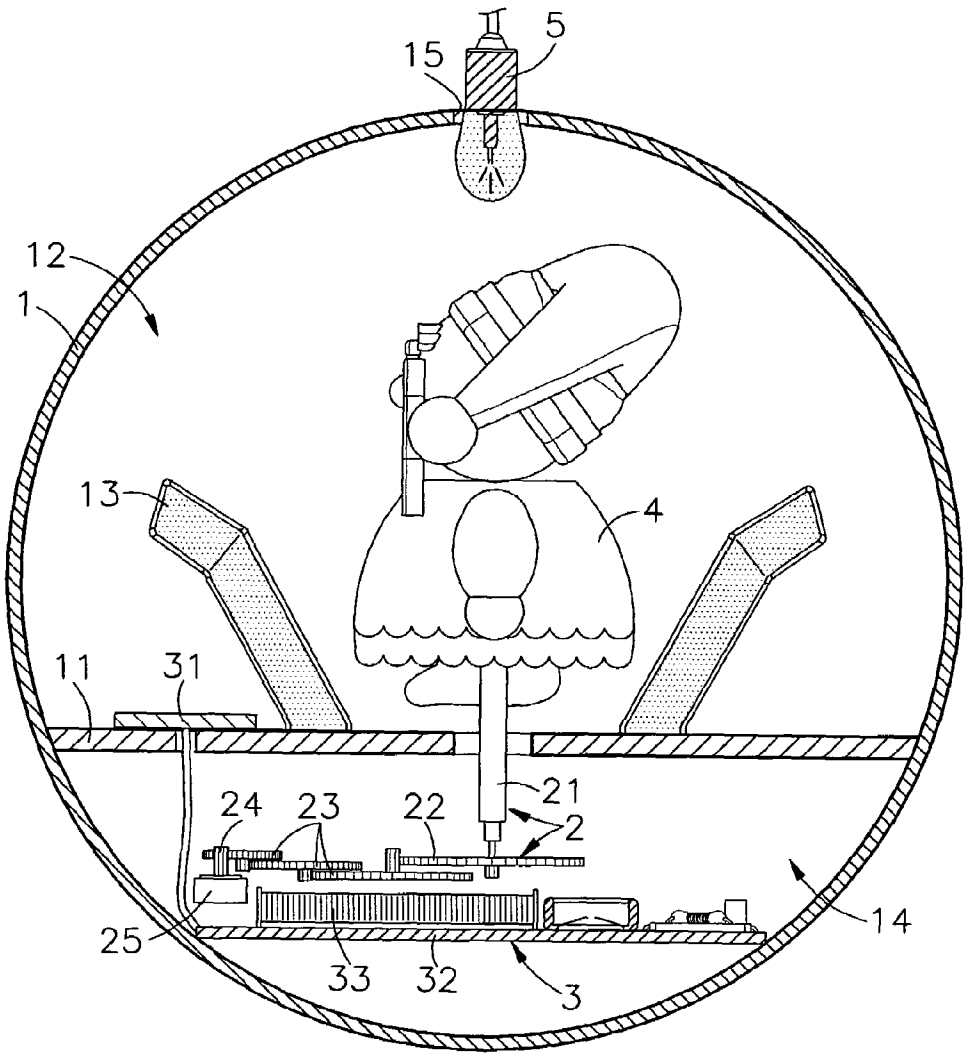
FIG. 1 is a sectional view of a display ornament in accordance with a first embodiment of the present invention.
Figure 2:
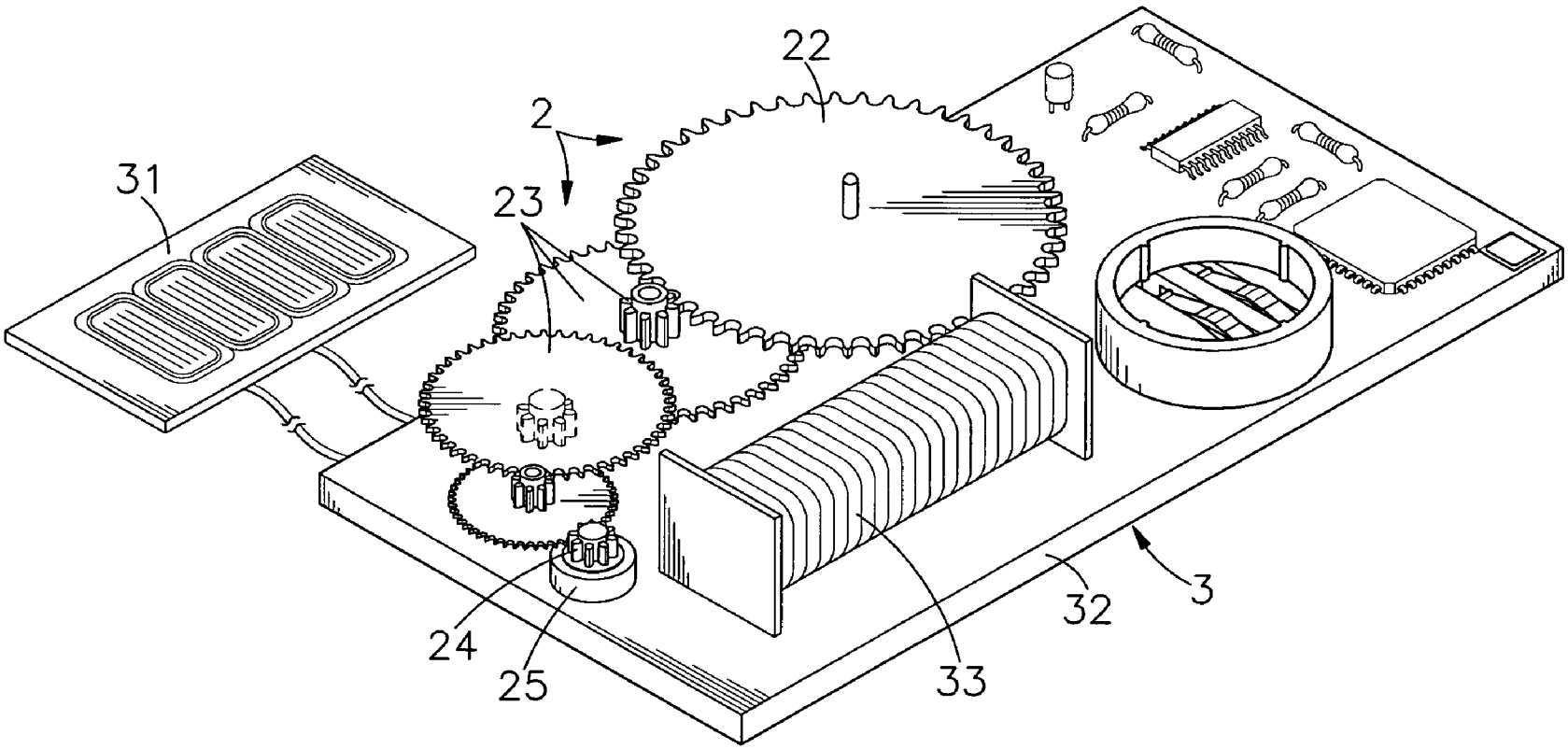
FIG. 2 is an elevational view in an enlarged scale of a part of the display ornament in accordance with the first embodiment of the present invention, showing the structure of the driving mechanism and the power supply unit.

Referring to FIGS. 1 and 2, a display ornament in accordance with a first embodiment of the present invention is shown comprising a container 1, an ornament 4 mounted inside the container 1, a driving mechanism 2 mounted inside the container 1 and adapted to move the ornament 4, and a power supply unit 3 mounted inside the container 1 and adapted to provide electrical energy for the working of the circuit system of the display ornament. The display ornament is for hanging on a tree or artificial tree, or any of a variety of support means during a festival or particular memorial day (Christmas, New year, Halloween, etc.).

The container 1 is made of a transparent or translucent material, having a partition board 11 that divides the inside space of the container 1 into an upper chamber 12 and a lower chamber 14. The upper chamber 12 is adapted to accommodate the ornament 4. The lower chamber 14 is adapted to accommodate the driving mechanism 2 and the power supply unit 3. Multiple light guides 13 are affixed to the partition board 11 and suspending in the upper chamber 12. The container 1 further has an insertion hole 15 cut through the periphery thereof in communication between the upper chamber 12 and the atmosphere.

The driving mechanism 2 comprises a driving gear 24, an output gearwheel 22, a rod member 21 perpendicularly extending from the center of one side of the output gearwheel 22 and inserted through (a hole on) the partition board 11 and fixedly connected to the ornament 4 to support the ornament 4 in the upper chamber 12, a transmission gear train 23 coupled between the driving gear 24 and the output gearwheel 22, and a magnet 25 fixedly provided at the bottom side of the driving gear 24.

The power supply unit 3 is comprised of a solar panel 31, a circuit board 32, and a solenoid 33. The solar panel 31 is for collecting radiation energy of visible lights and converting collected radiation energy into electric current for the circuit board 32, for enabling an oscillation circuit 321 of the circuit board 32 (see FIG. 3) to output signal to the solenoid 33.

Figure 3:
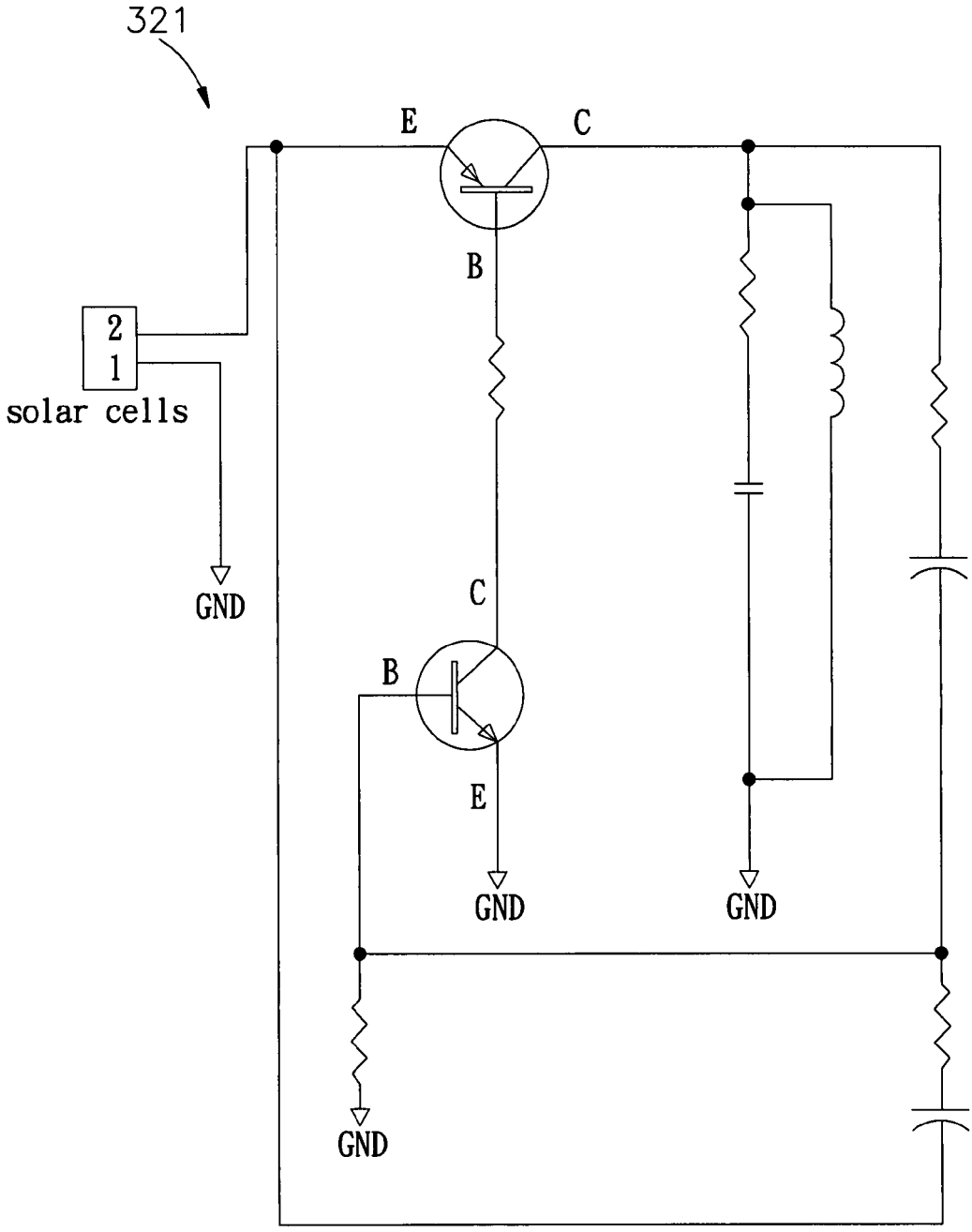
FIG. 3 is a circuit diagram of a control circuit for the display ornament according to the present invention.

Referring to FIG. 3, the oscillation circuit 321 of the circuit board 32 of the power supply unit 3 is electrically connected to the solar panel 31 and the solenoid 33. When the loop of the solar panel 31 and the oscillation circuit 321 of the circuit board 32 is ON, the oscillation circuit 321 can turn on/off the solenoid 33.

Referring to FIGS. 1 and 2 again, the container 1 is hung on a Christmas tree or support, and a light source 5 is inserted into the insertion hole 15 of the container 1. The light source 5 can be a lamp bulb, LED (light emitting diode), full-color LED, or high brightness LEDs of different colors. The solar panel 31 is mounted on the partition board 11 to collect the energy of light from the light source 5 and to convert light energy into electrical energy. Electrical energy is then provided by the solar panel 31 to the circuit board 32, enabling the oscillation circuit 321 of the circuit board 32 to control On/Off of the solenoid 33. When the solenoid 33 is On, it produces a magnetic field to attract the magnet 25 at the driving gear 24. Continuously alternating On/Off of the solenoid 33 causes movement of the magnet 25, and therefore the driving gear 24 is rotated. The rotary driving force of the driving gear 24 is transferred through the transmission gear train 23 to the output gearwheel 22, thereby causing rotation of the ornament 4 with the rod member 21 and the output gearwheel 22. During rotation of the ornament 4, the light source 5 illuminates the upper chamber 12, and therefore the display ornament generates visual effects.

Further, when the light source 5 is On, the light guides 13 guide light in different directions, enhancing the visual effects. Further, the solar panel 31 can collect light energy from an external light source and convert light energy into electrical energy for the working of the circuit board 32.

Figure 4:
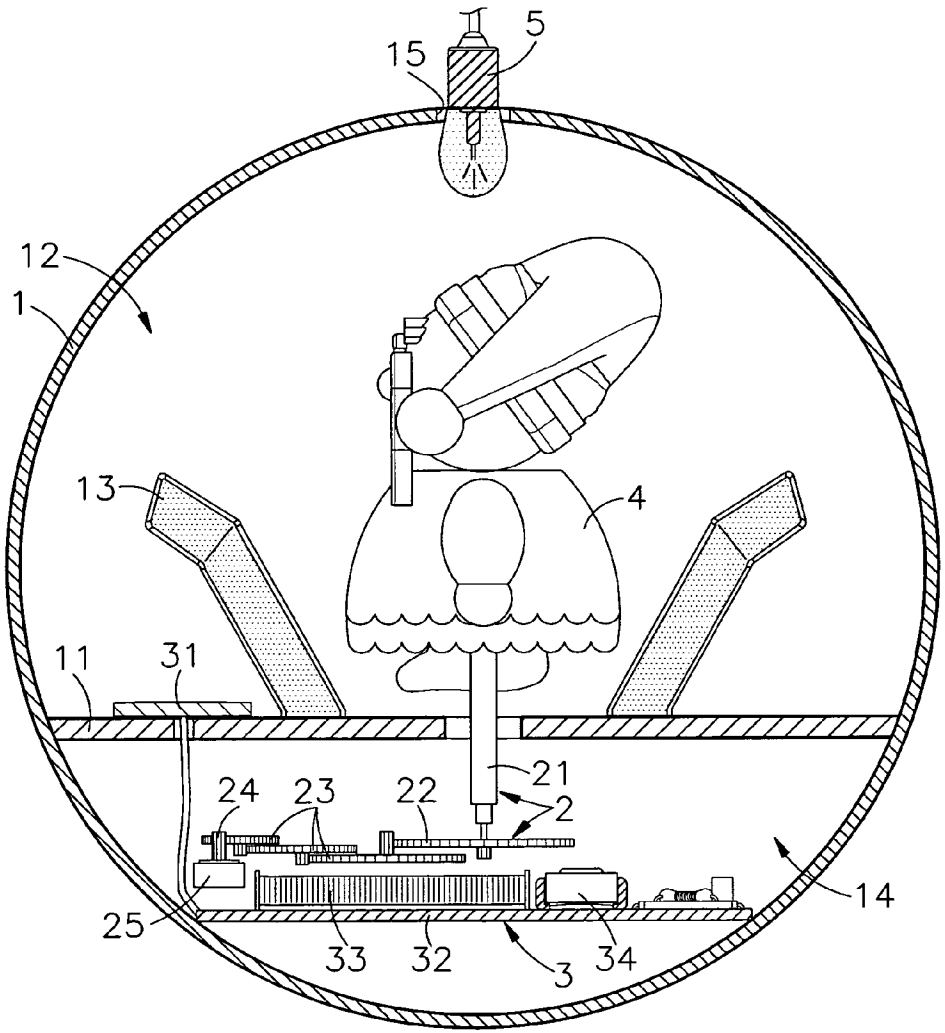
FIG. 4 is a sectional view of a display ornament in accordance with a second embodiment of the present invention.

FIG. 4 is a sectional view of a display ornament in accordance with a second embodiment of the present invention. This embodiment is substantially similar to the aforesaid first embodiment with the exception of the added battery pack, referenced by 34. When the light source 5 is On, the solar panel 31 collects light energy from the light source 5 and converts light energy into electrical energy for the working of the circuit board 32. When the light source 5 is off, the battery pack 34 provides the necessary electrical energy to the circuit board 32. Switching of the supply of electrical energy between the solar panel 31 and the battery pack 34 can easily be achieved by means of conventional techniques. Therefore, no further detailed description in this regard is necessary. The battery pack 34 can be a storage battery chargeable by electrical energy produced by the solar panel 31.

Figure 5:
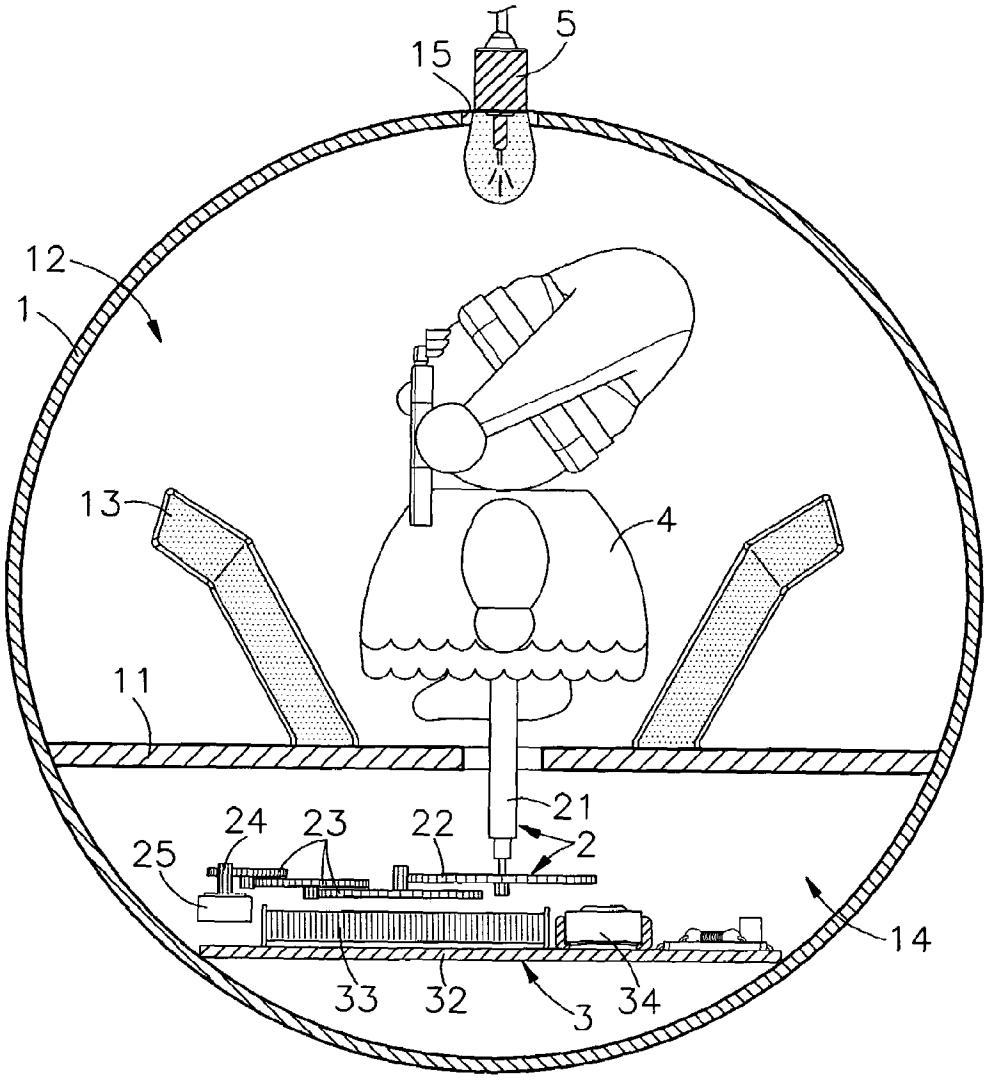
FIG. 5 is a sectional view of a display ornament in accordance with a third embodiment of the present invention.

FIG. 5 is a sectional view of a display ornament in accordance with a third embodiment of the present invention. This embodiment is substantially similar to the aforesaid second embodiment. However, this embodiment eliminates the aforesaid solar panel, i.e., the necessary working voltage for the circuit board 32 and the solenoid 33 is exclusively obtained from the battery pack 34. When electric current is provided to the circuit board 32, the solenoid 33 is driven to attract and release the magnet 33 continuously alternatively, causing rotation of the driving gear 24, and therefore the ornament 4 is rotated.

As stated above, the ornament 4 in the container 1 is rotatable by the driving mechanism 2, the light source 5 gives off light, and the solar panel 31 or battery pack 34 provides electrical energy to the circuit board 32 for enabling the solenoid 33 to attract and release the magnet 33 and to further move the driving mechanism 2.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A display ornament comprising a container, an ornament mounted inside said container, a driving mechanism mounted inside said container and adapted to move said ornament, and a power supply unit mounted inside said container and adapted to provide electrical energy for the working of the display ornament, wherein:

said container comprises a partition board, an upper chamber defined therein above said partition board for accommodating said ornament, a light source adapted to illuminate said upper chamber, a lower chamber defined therein below said partition board for accommodating said driving mechanism and said power supply unit;

said driving mechanism comprises a driving gear, magnetic means fixedly provided at a bottom side of said driving gear, an output gearwheel, a rod member perpendicularly extending from the center of one side of said output gearwheel and inserted through said partition board and fixedly connected to said ornament to support said ornament in said upper chamber, and a transmission gear train coupled between said driving gear and said output gearwheel;

said power supply unit comprises a solar panel for collecting light energy from said light source and converting light energy into electrical energy, a circuit board electrically connected to said solar panel, and a solenoid controlled by said circuit board to attract said magnetic means and to further cause rotation of said driving gear.

2. The display ornament as claimed in claim 1, wherein said container has an insertion hole on the periphery thereof for receiving said light source.

3. The display ornament as claimed in claim 1, wherein said container is a transparent container.

4. The display ornament as claimed in claim 1, wherein said container is a translucent container.

5. The display ornament as claimed in claim 1, further comprising light guide means mounted inside said upper chamber for guiding light from said light source toward predetermined directions.

6. The display ornament as claimed in claim 1, wherein said light source is provided at one visible side of said container to emit light toward said solar panel.

7. The display ornament as claimed in claim 1, wherein said light source is selected from one of at least one lamp bulb, at least one light emitting diode, at least one full color light emitting diode, and multiple high brightness light emitting diodes of different colors.

8. The display ornament as claimed in claim 1, wherein said power supply unit further comprises a rechargeable battery pack electrically connected to said circuit board and said solar panel for storage of electrical energy produced by said solar panel.

9. A display ornament comprising a container, an ornament mounted inside said container, a driving mechanism mounted inside said container and adapted to move said ornament, and a power supply unit mounted inside said container and adapted to provide electrical energy for the working of the display ornament, wherein:

said container comprises a partition board, an upper chamber defined therein above said partition board for accommodating said ornament, a light source adapted to illuminate said upper chamber, a lower chamber defined therein below said partition board for accommodating said driving mechanism and said power supply unit;

said driving mechanism comprises a driving gear, magnetic means fixedly provided at a bottom side of said driving gear, an output gearwheel, a rod member perpendicularly extending from the center of one side of said output gearwheel and inserted through said partition board and fixedly connected to said ornament to support said ornament in said upper chamber, and a transmission gear train coupled between said driving gear and said output gearwheel;

said power supply unit comprises a battery pack, a circuit board electrically connected to said battery pack, and a solenoid controlled by said circuit board to attract said magnetic means and to further cause rotation of said driving gear.

10. The display ornament as claimed in claim 9, wherein said container has an insertion hole on the periphery thereof for receiving said light source.

11. The display ornament as claimed in claim 9, wherein said container is a transparent container.

12. The display ornament as claimed in claim 9, wherein said container is a translucent container.

13. The display ornament as claimed in claim 9, further comprising light guide means mounted inside said upper chamber for guiding light from said light source toward predetermined directions.

14. The display ornament as claimed in claim 9, wherein said light source is provided at one visible side of said container to emit light toward said solar panel.

15. The display ornament as claimed in claim 9, wherein said light source is selected from one of at least one lamp bulb, at least one light emitting diode, at least one full color light emitting diode, and multiple high brightness light emitting diodes of different colors.

16. The display ornament as claimed in claim 9, wherein said power supply unit further comprises a solar panel electrically connected to said battery pack and said circuit board for converting light energy from said light source into electrical energy for charging said battery pack.

* * * * *